US005680054A

United States Patent [19]

Gauthier

[11] Patent Number: 5,680,054

[45] Date of Patent: Oct. 21, 1997

[54] BROKEN RAIL POSITION DETECTION USING BALLAST ELECTRICAL PROPERTY MEASUREMENT

[75] Inventor: Cyprien Gauthier, Sept-Iles, Canada

[73] Assignee: Chemin de fer QNS&L, Quebec, Canada

[21] Appl. No.: 607,487

[22] Filed: Feb. 27, 1996

[51] Int. Cl.[6] ..... G01R 27/02

[52] U.S. Cl. ..... 324/713; 324/693; 324/705; 340/686; 246/121; 246/34 R

[58] Field of Search ..... 324/509, 510, 324/522, 525, 527, 538, 556, 693, 705, 713, 718; 340/650, 651, 652, 686, 687; 246/28 F, 34 B, 34 R, 120, 121, 128, 129, 130

[56] References Cited

U.S. PATENT DOCUMENTS

| | | | |
|---|---|---|---|
| 52,567 | 5/1866 | Biermann . | |
| 122,264 | 1/1871 | Lang . | |
| 133,457 | 2/1872 | Patterson . | |
| 540,054 | 5/1895 | Henry . | |
| 1,340,197 | 5/1920 | Wells . | |
| 1,502,934 | 12/1924 | Barnett | 324/522 |
| 3,696,243 | 10/1972 | Risely | 246/121 |
| 3,870,952 | 3/1975 | Sibley | 324/693 |
| 4,117,529 | 9/1978 | Stark et al. | 246/34 R |
| 4,306,694 | 12/1981 | Kuhn | 246/121 X |
| 4,389,033 | 6/1983 | Hardman | 246/28 F |
| 4,432,517 | 2/1984 | Ripamonti | 246/28 F |
| 4,728,063 | 3/1988 | Petit et al. | 246/43 R |
| 4,886,226 | 12/1989 | Frielinghaus | 246/121 |

FOREIGN PATENT DOCUMENTS 1100594 5/1981 Canada .

*Primary Examiner*—Vinh P. Nguyen
*Assistant Examiner*—Diep Do
*Attorney, Agent, or Firm*—Michael D. Bednarek; Kilpatrick Stockton LLP

[57] ABSTRACT

The position of a break in at least one of a pair of rails in an electrically isolated rail segment of a railroad is carried out by measuring current across the ballast between the rails of the segment from one end of the segment when one of the rails in the segment is not broken and subsequently when the rail is broken. A position of the break can be calculated as a function of the ballast current. A linear approximation using the ratio of the ballast current when the rail is broken to the ballast current when the rail is not broken multiplied by the distance of the rail segment from the one end gives a satisfactory approximation of the location of the rail break.

18 Claims, 2 Drawing Sheets

BROKEN RAIL POSITION DETECTION USING BALLAST ELECTRICAL PROPERTY MEASUREMENT

FIELD OF THE INVENTION

The present invention relates to a method and apparatus for locating a position of a break in one of a pair of rails in an electrically isolated segment of a railroad. More particularly, the invention relates to such a method and apparatus in which an electrical property of a ballast medium extending between the pair of rails is measured to determine the position of the rail break.

BACKGROUND OF THE INVENTION

A broken rail in a railroad represents a major danger in railroad traffic. A broken rail may be imperceptible to the eye, but when a loaded train passes over the broken rail, it may cause a derailment of the train resulting in extensive damage, either to passengers or cargo, or to the environment as a result of cargo spills. Rapid and precise rail break detection is thus important to railroad operations and management.

The traditional method of railroad integrity detection has been to send a low voltage pulsed DC current down one rail and back through the opposed rail in an electrically isolated segment (also referred to as a block) of the railroad. The segment may have a length of about 0.1 to 5 kilometers and is electrically isolated from contiguous or adjoining segments. A series contiguous segments form a section for signaling purposes (known as a controlled block) and may have a length of 10 to 20 km. The term isolated is used in this specification instead of insulated because the rails are not electrically insulated with respect to the ballast or ground to which they are mounted. In the traditional method, the presence or absence of current (either continuous or pulsed) was detected to confirm that the rails were conducting and not broken or shorted at some point over the segment.

The primary object of the traditional method was to provide a check of the block by checking the integrity of the rail. By inserting an electrical code signal at one end of the block and decoding the signal received at the other end of the block, it can then be considered safe for a train to engage itself in this block. When a train has its truck of wheels on the rails, the truck conducts electricity and provides a short across the rails. For example, when the voltage is applied at one end of the segment with a terminal resistance at the other end, the presence of a train is detected at the voltage source end by measuring an increase in current flow, and at the other end by measuring a drop in voltage across the terminal resistance. It is also known to provide a relay at the terminal end, the relay changing state when a train is on the segment (or when the rails is broken and non-conducting). The segments of a section were electrically connected by the relays to bring the whole section down (i.e. a red signal indicating it was unsafe for passage) when there was a short or rail break in any segment.

As can be appreciated, the known method is only capable of checking continuity of the entire segment. Thus, to actually determine the location of the broken rail it is necessary to inspect the segment of railroad to find the location of the break and effect any repairs required. Such inspection could be visual or possibly also electrical, i.e. running a vehicle with insulated wheels so the rail is not shorted and measuring voltage between both front wheels and analog meter inside the vehicle will indicate the presence of the code between left and right rails. The meter will lose its reading when the vehicle runs outside the block or if the rail is broken between the vehicle and the source of the code. Such testing is time consuming, and may prove unsuccessful either due to limitations of the test (visual inspection is difficult) or due to the fact that the break has rejoined due to thermal expansion. Furthermore, it can be very expensive to dispatch a test crew to the railroad segment to carry out the time consuming test.

SUMMARY OF THE INVENTION

It is an object of the present invention to overcome the drawbacks of the known broken rail position detection methods and apparatus. According to a general aspect of the invention, there is provided a method and apparatus in which an electrical property of a ballast medium extending between the pair of rails is measured to determine the position of the rail break.

According to the invention, there is provided a method for detecting a position of a break in at least one of a pair of rails in an electrically isolated rail segment of a railroad, comprising the steps of: measuring an electrical property in a ballast between the rails of the segment from one end thereof when one of the rails in the segment is not broken; measuring an electrical property in a ballast between the rails of the segment from one end thereof when one of the rails in the segment is broken; and calculating a position of the break as a function of the measured ballast electrical property of the segment when the segment is broken and when the segment is not broken. The electrical property of the ballast in the segment or block is different when one of the rails in the segment is broken. As can be appreciated, the calculation of the position of the rail break requires knowledge of the ballast electrical property before the break. Since the ballast electrical property can vary greatly under different moisture and weather conditions, the measurement of the ballast electrical property must be done as often as may be required under the climatological circumstances, e.g. every few minutes.

There is also provided according to the present invention an apparatus for detecting a position of a break in at least one of a pair of rails in an electrically isolated rail segment of a railroad, comprising: means for providing an electrical test signal between rails of the segment at one end thereof; measurement means for detecting the test signal and measuring an electrical property of a ballast interconnecting the rails; position calculating means for calculating a position of a break in one of the rails as a function of the measured electrical property when the rails are free of a break and when one of the rails is broken.

Preferably, the electrical property is resistance or conductivity, and the test signal is simply a DC voltage. The DC voltage may be pulsed, e.g. 75, 120 or 180 pulses per minute. A sine wave signal can also be used.

BRIEF DESCRIPTION OF THE DRAWINGS

The invention will be better understood by way of the following detailed description of a preferred embodiment with reference to the appended drawings in which.

DETAILED DESCRIPTION OF THE PREFERRED EMBODIMENT

Figure 1:
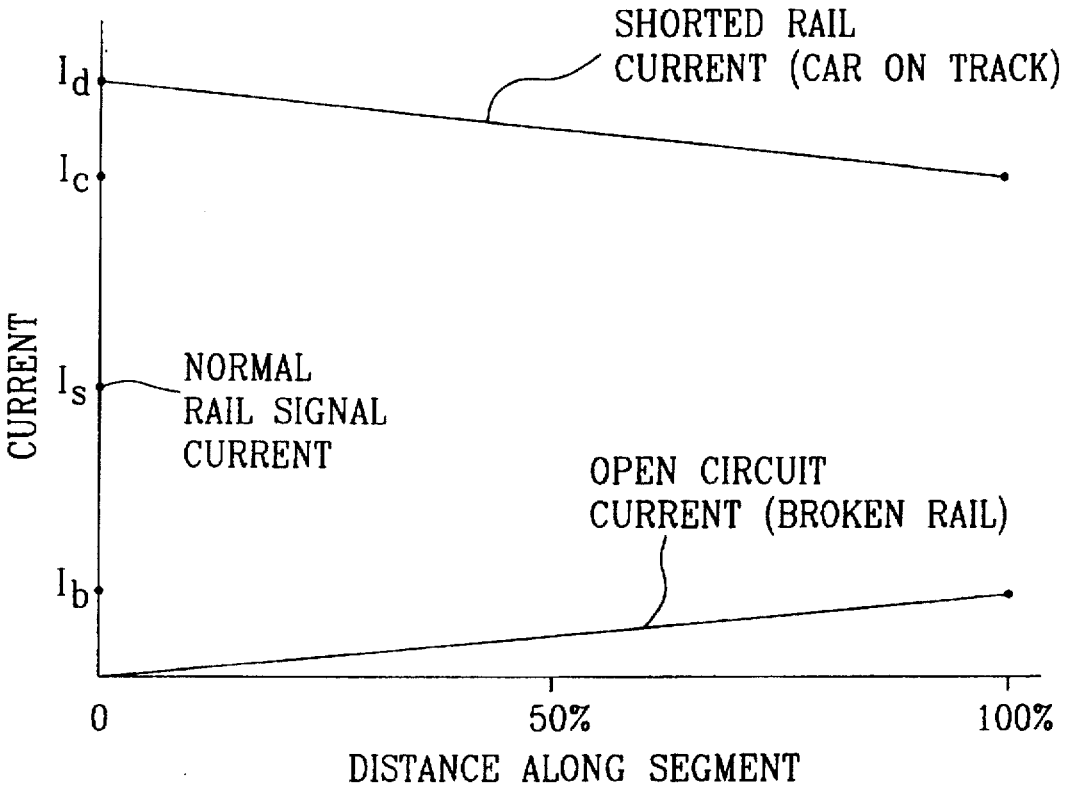
FIG. 1 is a graph of current versus distance along the segment in the case of a rail car moving along the track and a broken rail at some point along the segment.
Figure 2:
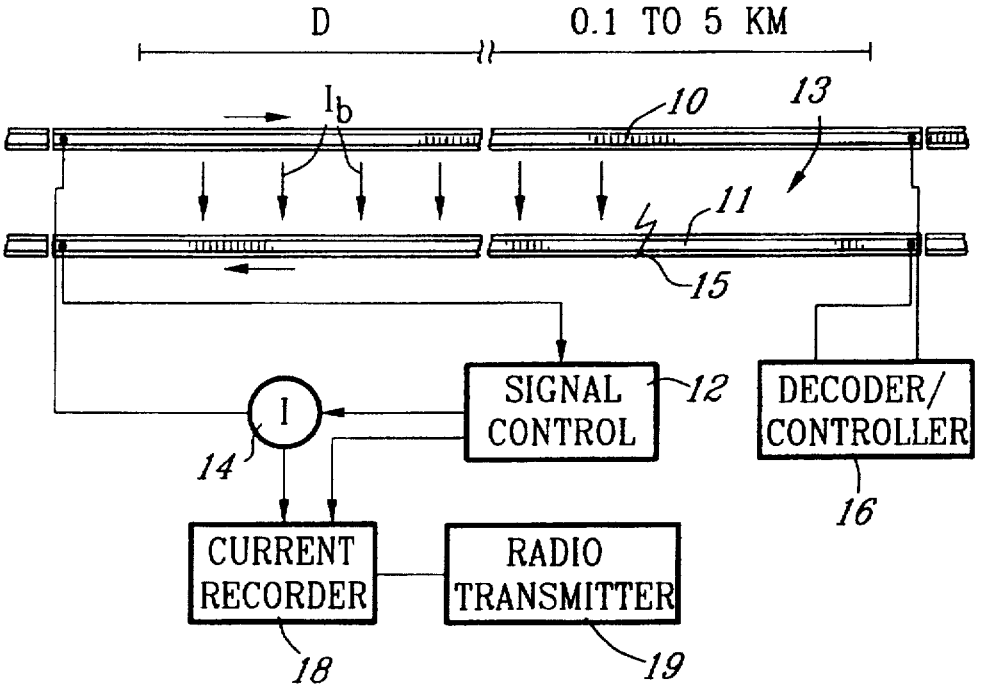
FIG. 2 is a schematic block electrical diagram of an electrically isolated segment provided with a testing circuit according to the preferred embodiment.

With reference to FIGS. 1 and 2, the circuit and operation of the apparatus according to the preferred embodiment will be described. A railroad segment comprises a pair of rails 10 and 11 which are electrically cut off from contiguous segments of the railroad. The segment shown has a distance D. A signal generator and control circuit 12 sends a signal into the rails 10 and 11 and the current meter 14 is connected in series with the circuit to measure current flow. At an opposite end of the segment, a decoder and controller circuit 16 is connected across the rails 10 and 11 and detects the signal sent along the rails for signaling control as is known in the art.

A circuit is thus provided having a path leading from signal control circuit 12 to current meter 14 to rail 10 to controller circuit 16 through an internal terminal resistance in controller 16 to rail 11 back to signal control circuit 12. The terminal resistance provides a noticeable drop in current measured as a rail car shorts out the terminal resistance at the end of the section near the controller 16. The decoder and controller circuit 16, however, differs from conventional circuits in that it responds to a special code sent by the signal control circuit 12 by disconnecting any load i.e. the terminal resistance, from the rails 10 and 11 for a predetermined period of time such as one second. During this one second time period, the signal control circuit 12 applies a low voltage DC test signal of approximately one volt between the rails and the current detector 14 measures the small amount of current passing between rails 10 and 11 through the ballast 13. This low level of current $I_b$ is recorded by current recorder 18.

The current recorder 18 also examines the current measurement from meter 14 when a signal code is being sent through rails 10 and 11 and across the terminal resistance in the controller circuit 16 to confirm that the current level is normal. The normal rail signal current, $I_s$, as shown in FIG. 1, is the current passsing through the rails and terminal resistance when no car is on the segment and no rail break is present for a given signal voltage. If the current level is much greater than the normal rail signal current, this means that the circuit has been shorted by a railroad car present on rails 10 and 11 at some point on the segment. If the rails are being shorted at the end of the segment where the signal is injected by the signal control circuit 12, the current measured will be the maximum current Id which the control circuit 12 will deliver and at the remote end where the decoder 16 is located, a short will result in current Ic. As the railcar moves from the remote end of the segment to the circuit 12, the current will increase slightly and substantially linearly to current level Id since the resistance of rails 10 and 11 is now included in the circuit. The current level Ic is a value which can be measured when a railcar first crosses onto the segment from the adjacent segment at the decoder controller end, or by calculating the quotient of the applied voltage and the difference of the terminal resistance and the quotient of applied voltage and the normal current $I_c=V/(I_s-V/R_t)$. The exact value of $I_c$ will typically only vary by a small amount as a result of changes in the resistance in the rails due to temperature.

Reference numeral 15 indicates a break in the rail 11. In this case, rail 10 will be at the potential set by signal controller circuit 12. Current will flow from rail 10 only across the ballast 13 as indicated by the arrows to the portion of rail 11 from the break 15 extending back to the end where the connection signal control circuit 12 is connected. This ballast current is a small fraction of the normal current rail signal but is large enough to measure. Signal control circuit 12 applies the low voltage DC test signal level applied to the rails 10 and 11 during the one second period while the controller circuit 16 disconnected any load across the rails, and the current I is measured by meter 14. The fraction of the current passing indicates approximately the fraction of the length of the rail 11 leading up to the break with respect to the entire length of the segment D. Thus, a linear approximation of the position of the break 15 is given merely by the equation $$\frac{I}{I_b} * D$$

where I is the open circuit current with a rail break, and $I_b$ is the normal open circuit ballast current. To confirm this estimate, it would also be possible to provide the decoder and controller circuit 16 with circuitry similar to elements 12, 14 and 18 in order to be able to carry out the same open circuit current measurement and determine the ballast current between rail 10 and rail 11 for the segment between break 15 and the decoder controller end of the segment.

Figure 3:
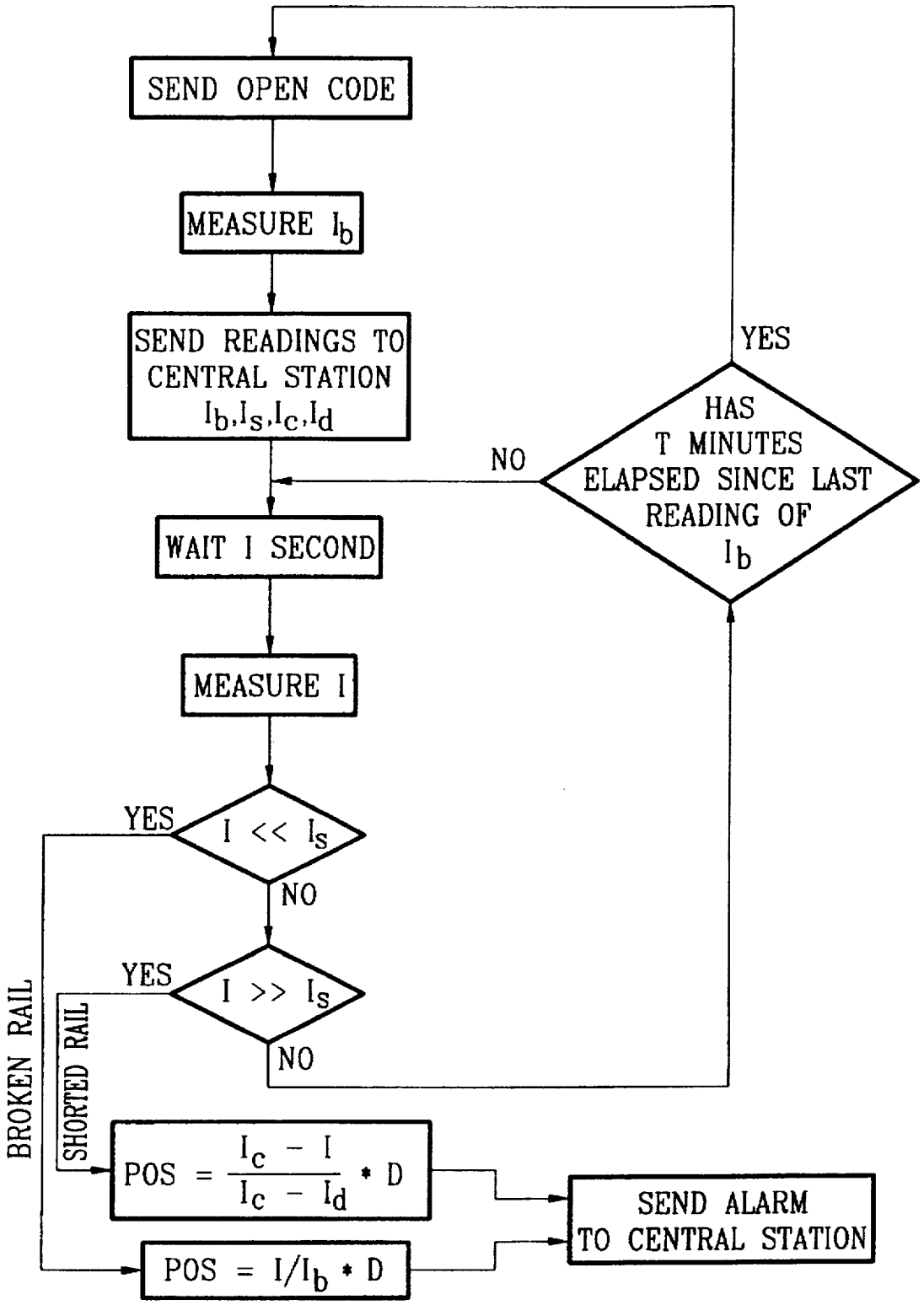
FIG. 3 is a flow chart of the method according to the preferred embodiment.

As illustrated in FIG. 3, the method according to the preferred embodiment can be summarized as follows. The signal control circuit sends an open circuit code through rails 10 and 11 which, when decoded by the decoder and controller circuit 16, causes the load at the decoder end of the segment to be disconnected for a period of one second. The open circuit signal code may be, for example, a special pulse frequency or pulse duration. During this interval, a low voltage DC test pulse signal applied to the rails 10 and 11 by the signal control circuit 12 has its current measured by current detector 14 and this $I_b$ current value is recorded by current recorder as the recorded value for the future $$\frac{I}{I_b}$$

calculation. This ballast current measurement will change as the weather changes, namely the ballast current will increase if the ballast is moist and will decrease when dry or frozen. After the one second period, when the decoder controller circuit 16 provides a load across rails 10 and 11 and closes the circuit, the signal control circuit 12 sends a normal signal code during which the current recorder measures the current I. If the current measured is much less than the expected signaling current (i.e. $I \ll I_s$) then the current value recorded ($I_b$) is used to calculate the position of the rail break 15. If the measured current is normal and the time interval T of between 2 and 5 minutes has elapsed, then the process repeats itself. If the current measured is much greater than the expected signaling current (i.e. $I \gg I_s$) then a rail car has passed onto the segment and its position is calculated by $Pos=(I_c-I)/(I_c-I_d)* D$. In either case of $I \gg I_s$ or $I \ll I_s$, an alarm message is sent to a central station using transmitter 19. The alarm message identifies the nature of the alarm and the calculated Pos value. Additionally, the current values I, $I_b$, $I_s$, $I_c$ and $I_d$ may also be transmitted.

According to the preferred embodiment, the measured current values $I_b$, $I_s$, $I_c$ and $I_d$ can be sent by radio transmitter after every line interval T, to a central station for central monitoring. The information transmitted can provide the central station with information on the position of trains and, most importantly, in accordance with the present invention a calculation of the position of a rail break can be obtained in order to dispatch a repair crew and, if possible, reroute rail traffic to avoid the rail break.

As can be appreciated, when the rail break is a mere fracture of a rail, the open circuit condition may only be detected when temperature drops. For example, if a rail is fractured by thermal expansion and contraction, the rail may be cracked, yet it may still conduct since the temperature is relatively warm. In the winter time, it may remain connected and conductive until the ambient temperature reaches an extreme cold value which may not occur until very early in the morning. By 10 am., it is possible that the temperature has increased enough to cause the rail to conduct again. If the rail break was to be located using normal conductivity testing, a test crew dispatched in the morning would not have time to be organized and sent to a remote segment of the railroad in time to inspect the entire length by 10 am. Thus, one would never find the rail break by ordinary conductivity testing. With the present invention, the position of the rail break is calculated as soon as it is detected. Even if the conductivity of the rail has been restored by thermal expansion, a crew dispatches to a particular location within the segment will likely only need to scan a length of between 50 to 200 meters of track in order to locate the actual rail break. With such concentration of efforts, a careful visual inspection as well as other forms of rail inspection can be efficiently undertaken.

What is claimed is:

1. A method for detecting a position of a break in at least one of a pair of rails in an electrically isolated rail segment of a railroad, comprising the steps of:

measuring an electrical property in a ballast between said rails of said segment from one end thereof when one of said rails in said segment is not broken;

measuring an electrical property in a ballast between said rails of said segment from one end thereof when one of said rails in said segment is broken; and calculating a position of the break as function of said measured ballast electrical property of said segment when said segment is broken and when said segment is not broken, said ballast electrical property being different when one of said rails in said segment is broken.

2. The method as claimed in claim 1, wherein said electrical property is resistance or conductivity.

3. The method as claimed in claim 1, wherein another terminal end of said segment is normally connected to a load for signaling purposes, said step of measuring said electrical property when one of said rails in said segment is not broken comprising an initial step of disconnecting said load.

4. The method as claimed in claim 3, wherein said initial step comprises sending a special code from said one end of said segment to a decoder circuit at said other terminal and in response to which said decoder disconnects said load for a period of time.

5. The method as claimed in claim 2, wherein another terminal end of said segment is normally connected to a load for signaling purposes, said step of measuring said electrical property when one of said rails in said segment is not broken comprising an initial step of disconnecting said load.

6. The method as claimed in claim 2, wherein said initial step comprises sending a special code from said one end of said segment to a decoder circuit at said other terminal and in response to which said decoder disconnects said load for a period of time.

7. The method as claimed in claim 1, wherein said steps of measuring are repeated at regular intervals, whereby a recent measurement of the ballast electrical property is on hand whenever one of said rails is broken so that the calculated position is more accurate, given that the ballast electrical property may change overtime and in particular in accordance with weather conditions.

8. The method as claimed in claim 2, wherein said steps of measuring are repeated at regular intervals, whereby a recent measurement of the ballast electrical property is on hand whenever one of said rails is broken so that the calculated position is more accurate, given that the ballast electrical property may change overtime and in particular in accordance with weather conditions.

9. An apparatus for detecting a position of a break in at least one of a pair of rails in an electrically isolated rail segment of a railroad, comprising:

means for providing an electrical test signal between rails of said segment at one end thereof;

measurement means for detecting said test signal and measuring an electrical property of a ballast interconnecting said rails;

position calculating means for calculating a position of a break in one of said rails as a function of said measured electrical property when said rails are free of a break and when one of said rails is broken, said electrical property being different when one of said rails is broken.

10. The apparatus as claimed in claim 9, wherein said property is conductivity or resistance, and said test signal is a DC voltage.

11. The apparatus as claimed in claim 9, wherein a signal decoder circuit is connected to another terminal end of said segment, said decoder circuit normally providing a current path through said rails for signaling purposes, said decoder disconnecting said rails from one another for the purposes of measuring said test signal.

12. The apparatus as claimed in claim 11, wherein said means for providing an electrical test signal send a special code to said decoder in response to which said decoder disconnects a current path between said rails for a predetermined period of time.

13. The apparatus as claimed in claim 9, further comprising radio transmitter means for transmitting said calculated position to a central station.

14. The apparatus as claimed in claim 9, wherein said electrical property is measured at regular intervals and recorded, whereby a recent measurement of the ballast electrical property is on hand whenever one of said rails is broken so that the calculated position is more accurate, given that the ballast electrical property may change overtime and in particular in accordance with weather conditions.

15. The apparatus as claimed in claim 10, wherein a signal decoder circuit is connected to another terminal end of said segment, said decoder circuit normally providing a current path through said rails for signaling purposes, said decoder disconnecting said rails from one another for the purposes of measuring said test signal.

16. The apparatus as claimed in claim 10, wherein said means for providing an electrical test signal send a special code to said decoder in response to which said decoder disconnects a current path between said rails for a predetermined period of time.

17. The apparatus as claimed in claim 10, further comprising radio transmitter means for transmitting said calculated position to a central station.

18. The apparatus as claimed in claim 10, wherein said electrical property is measured at regular intervals and recorded, whereby a recent measurement of the ballast electrical property is on hand whenever one of said rails is broken so that the calculated position is more accurate, given that the ballast electrical property may change overtime and in particular in accordance with weather conditions.

* * * * *